US006072436A

United States Patent [19]

Marougi

[11] Patent Number: 6,072,436

[45] Date of Patent: Jun. 6, 2000

[54] INCORPORATION OF ANTENNA INTO VEHICLE DOOR PILLAR

[75] Inventor: LeeAnn Marougi, Bloomfield Township, Mich.

[73] Assignee: Lear Automotive Dearborn, Inc., Southfield, Mich.

[21] Appl. No.: 09/228,181

[22] Filed: Jan. 11, 1999

[51] Int. Cl.[7] ..... H01Q 1/32

[52] U.S. Cl. ..... 343/713; 343/711; 343/712

[58] Field of Search ..... 343/711, 712, 343/713

[56] References Cited

U.S. PATENT DOCUMENTS

| | | | |
|---|---|---|---|
| 4,247,850 | 1/1981 | Marcus | 340/694 |
| 4,721,963 | 1/1988 | Nagy et al. | 343/712 |
| 4,755,823 | 7/1988 | Ohe et al. | 343/713 |
| 4,806,942 | 2/1989 | Ohe et al. | 343/713 |
| 4,811,024 | 3/1989 | Ohe et al. | 343/712 |
| 4,811,025 | 3/1989 | Ohe et al. | 343/712 |
| 4,823,142 | 4/1989 | Ohe et al. | 343/713 |

*Primary Examiner*—Don Wong
*Assistant Examiner*—Jennifer H. Malos
*Attorney, Agent, or Firm*—Brooks & Kushman P.C.

[57] ABSTRACT

An antenna for an RF transmitter is incorporated into the front door pillar trim member in a vehicle cab. This location for the antenna maximizes the transmission characteristics of the antenna. A switch and a transmitter are also preferably mounted on the trim member. The switch and transmitter are incorporated into a garage door opening system. The antenna is ideally positioned to transmit a signal to the garage door opener.

1 Claim, 1 Drawing Sheet

INCORPORATION OF ANTENNA INTO VEHICLE DOOR PILLAR

BACKGROUND OF THE INVENTION

This invention relates to a unique placement of an antenna in a vehicle which provides functional benefits.

Modern vehicles are being provided with more and more electrical components. Some of those electrical components rely upon RF receivers or transmitters which must function in combination with an antenna. Examples include garage door opener systems, keyless entry systems, and navigational systems.

There have been challenges with these systems in that the power of the system to transmit or receive a signal is dependent on the size of its antenna. Thus, in one sense, it would be desirable to enlarge the antenna to increase the receiving or transmitting strength. However, as with all vehicle applications, there is also a general emphasis on reducing the size of a component.

In addition, the metal frame of the vehicle creates challenges for the functional use of an antenna. The frame of the vehicle can modify the field transmitted or received by the antenna.

A series of solutions to the above-discussed problems are disclosed in co-pending U.S. patent application Ser. No. 09/098,085 entitled "Integrated Antenna and Vehicle Trim Component". In this Application, it is proposed to incorporate the antenna into one of a series of vehicle trim components. The vehicle trim components are preferably positioned so as to be aligned with a window into the vehicle cab, such that the problems with regard to the metal frame are avoided.

It has been proposed in the prior art to incorporate antennas into the area adjacent to the front door pillar of the vehicle. These antennas have typically been utilized as receiver antennas for receiving radio or television signals. Further, these antennas have tended to be disclosed incorporated into the metal frame. Thus, these antennas do not provide any assistance for garage door opener structure, nor do they provide idealized positioning for the antenna since they are encased within the metal frame.

In addition, with prior art garage door opener systems, the operator may sometimes need to look away from the approaching direction, as the driver approaches the garage door, to find and access the garage door opener switch. This may be somewhat undesirable in some cases.

It is a goal of this Application to provide a unique solution improving upon the systems disclosed in the above-referenced patent application.

SUMMARY OF THE INVENTION

In a disclosed embodiment of this invention, an antenna for actuating a garage door opener is incorporated into the front door pillar. This is an ideal position since it is directed at the door. Also, preferably, the antenna is mounted in a trim member positioned adjacent to the front door pillar of a vehicle and outwardly of the metal frame. Preferably, a switch for actuating a system associated with the antenna may also be placed on the pillar trim member.

Preferably, the antenna is to the side of the metal frame, and thus facing forwardly. This is an ideal position for directing a signal toward an oncoming item, such as a garage door opener.

In this way, the antenna can point forwardly out of the front windshield of the vehicle and not be compromised by the metal frame of the vehicle. Moreover, this location for the antenna allows the placement of the control for the system onto the trim member on the front door pillar. This is a convenient location for the operator, and will not require the operator to look away from the oncoming items the vehicle is approaching. Thus, the operator pulling into the driveway need not look away to open the garage door. With the unique placement, the operator's eyes can still be forward, and need not look away to find the switch, Instead, the garage door opener switch is positioned in the driver's line of sight.

This and other features of the present invention can be best understood from the following specification and drawings.

DETAILED DESCRIPTION OF A PREFERRED EMBODIMENT

Figure 1A:
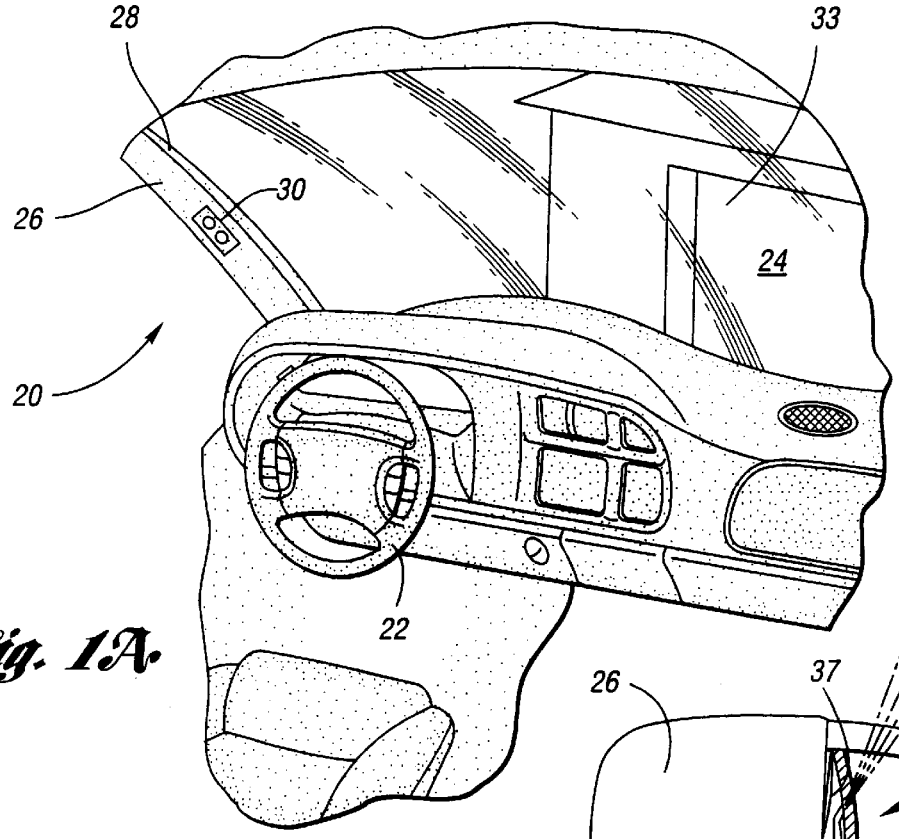
FIG. 1A is a schematic view of the invention incorporated into a vehicle cab.

FIG. 1A shows a vehicle cab 20 incorporating steering wheel 22 and the front windshield 24, as known. The front door pillar 26 is surrounded by a trim member 28, again as known.

Figure 1B:
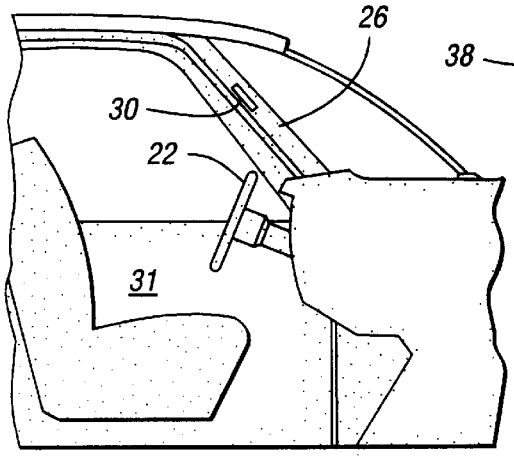
FIG. 1B is a side view of the FIG. 1A embodiment.

The invention incorporates a garage door opener switch 30 into the trim member 28. As the driver is approaching the garage door opener 33, the driver need not look away from oncoming items to actuate the switch 30. Instead, the switch 30 is ideally positioned. As shown in FIG. 1B, the pillar 26 is at the forward end of the door 31, again as known.

Figure 2:
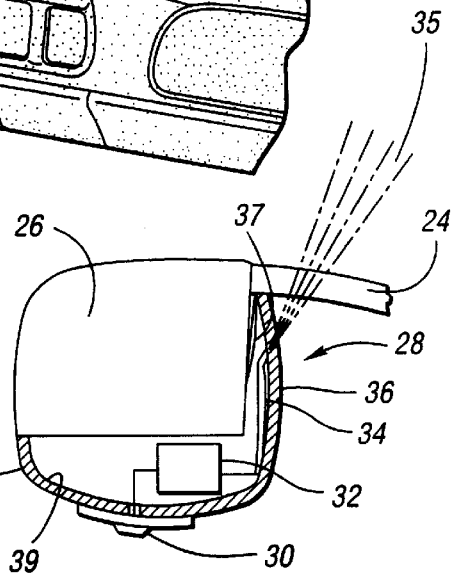
FIG. 2 is a cross-sectional view along line 2—2 as shown in FIG. 1A.

As can be appreciated from FIG. 2, the frame 26 is a metal member which is surrounded by the trim member 28. The shape of the frame is known, and is shown here as rectangular to schematically illustrate its shape. The switch 30 communicates with a transmitter 32, which sends an RF signal through an antenna 34 such as shown at 35. As shown, antenna 34 is positioned to the inside 37 of frame 26 such that it faces the oncoming garage door opener. The signal 35 will not be affected by the metal frame member 26, as it need only pass through the glass windshield 24.

As can also be appreciated from FIG. 2, the trim member 28 includes a first side 36 extending forwardly towards the windshield and a second side 38 extending generally parallel to the windshield 24. The transmitter 32 and antenna 34 are incorporated into an inner wall 39 of the trim 28. In this way, the antenna 34 has a transmission field 35 which may be less affected by the frame member 26, and which is in a an optimum position within the vehicle cab to deliver the signal to the garage door opener 33.

Figure 3:
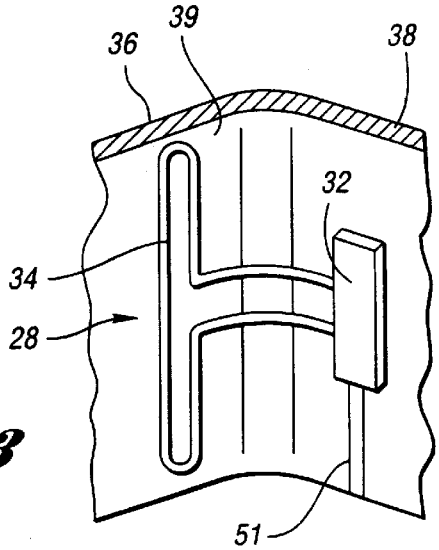
FIG. 3 is an inside view of the trim member according to the present invention.

As shown in FIG. 3, the trim member 28 has the antenna 34 on side 36, and the transmitter 32 on side 38. Switch 30 is on the opposed side of the trim member from the receiver 32. As shown, power is supplied through lines 51 to the transmitter 32 and switch 30.

The inventive placement of the antenna and garage door opener system maximizes the location within the vehicle cab, and thus provides valuable benefits.

Although a preferred embodiment of this invention has been disclosed, it should be understood that various modifications would come within the scope of this invention. For that reason, the following claims should be studied to determine the true scope and content of the present invention.

What is claimed is:

1. An antenna and electronic RF transmitter system for use with a vehicle garage door opener comprising a door pillar for an automotive vehicle body passenger compartment, the door pillar defining a forward part of a vehicle door opening and a lateral margin of a windshield opening for a glass windshield at the front of the passenger compartment;

a trim member surrounding said door pillar, the trim member having a first panel portion generally perpendicular to said windshield and a second panel portion generally parallel to said windshield;

an electronic RF transmitter mounted within said trim member;

a manually operable switch mounted on said second panel portion, said switch; being electrically connected to said transmitter; and a dipole antenna electrically connected to said transmitter, said antenna being located with a generally vertical orientation within said trim member between said door pillar and said windshield whereby RF signals may be directed forwardly through said windshield opening without interference from said door pillar;

said switch including a manually operable actuator portion on said second panel portion between upper and lower margins of said windshield opening whereby a vehicle operator may activate the switch without altering the forward visual focus of the vehicle operator through said windshield opening.

* * * * *